US007797896B2

(12) United States Patent
Miller et al.

(10) Patent No.: US 7,797,896 B2
(45) Date of Patent: Sep. 21, 2010

(54) LOG-CABIN TYPE FACADE

(75) Inventors: Alexander Miller, Eppingen (DE); Andreas Langlitz, Kiefernweg 19, 67346 Speyer (DE)

(73) Assignee: Andreas Langlitz, Speyer (DE)

( * ) Notice: Subject to any disclaimer, the term of this patent is extended or adjusted under 35 U.S.C. 154(b) by 854 days.

(21) Appl. No.: 10/579,016

(22) PCT Filed: Oct. 28, 2004

(86) PCT No.: PCT/EP2004/012170

§ 371 (c)(1), (2), (4) Date: Mar. 14, 2007

(87) PCT Pub. No.: WO2005/047611

PCT Pub. Date: May 26, 2005

(65) Prior Publication Data

US 2007/0204538 A1 Sep. 6, 2007

(30) Foreign Application Priority Data

Nov. 11, 2003 (DE) ..... 103 52 902

(51) Int. Cl.
*E04B 1/10* (2006.01)

(52) U.S. Cl. ..... 52/233; 52/284; 52/539; 52/592.1; 446/106

(58) Field of Classification Search ..... 52/233, 52/284, 539, 592.1; 446/106
See application file for complete search history.

(56) References Cited

U.S. PATENT DOCUMENTS 1,510,326 A * 9/1924 Locke ..... 52/92.1
1,655,701 A * 1/1928 Hyland et al. ..... 52/233
1,758,046 A * 5/1930 Ilson ..... 52/233
2,021,341 A * 11/1935 Ward ..... 52/233
2,130,231 A * 9/1938 Forciea ..... 52/233
2,403,934 A * 7/1946 Lindstrom ..... 52/233
2,525,659 A * 10/1950 Edson et al. ..... 52/233
3,189,950 A * 6/1965 Johnson ..... 52/233
3,381,428 A * 5/1968 Sillman ..... 52/233
3,800,494 A * 4/1974 Hall et al. ..... 403/331
4,096,674 A * 6/1978 Kollar et al. ..... 52/233
4,219,977 A * 9/1980 Bene et al. ..... 52/94
4,230,163 A * 10/1980 Barton ..... 144/341
4,279,108 A * 7/1981 Collister, Jr ..... 52/233
4,287,694 A * 9/1981 Cornell ..... 52/233
4,320,610 A * 3/1982 Rupp ..... 52/233
4,330,973 A * 5/1982 Marklund et al. ..... 52/233
4,337,941 A * 7/1982 Kitka ..... 482/36
4,391,077 A * 7/1983 Giess ..... 52/748.11
4,429,500 A * 2/1984 Farmont ..... 52/233
4,592,182 A * 6/1986 Felser ..... 52/233
4,649,683 A * 3/1987 Dolata ..... 52/233
4,742,657 A * 5/1988 Veech ..... 52/233

(Continued)

FOREIGN PATENT DOCUMENTS

DE 25 35 980 A 2/1976

*Primary Examiner*—Robert J Canfield
*Assistant Examiner*—Matthew J Gitlin
(74) *Attorney, Agent, or Firm*—Kriegsman & Kriegsman

(57) ABSTRACT

The invention relates to a log-cabin type façade for cladding walls in internal and external areas. Said façade comprises elongated contoured elements (12) and corner elements (16), which are designed to produce an interior corner and an exterior corner for internal and external areas.

17 Claims, 5 Drawing Sheets

U.S. PATENT DOCUMENTS 4,834,585 A * 5/1989 Hasenwinkle et al. ..... 405/286
4,878,328 A * 11/1989 Berge ..... 52/233
4,901,489 A * 2/1990 Garber ..... 52/233
4,909,012 A * 3/1990 Thompson et al. ..... 52/745.21
4,967,526 A * 11/1990 Yost ..... 52/233
5,010,701 A * 4/1991 Halsey et al. ..... 52/233
5,020,289 A * 6/1991 Wrightman ..... 52/233
5,282,343 A * 2/1994 Stein ..... 52/233
5,586,422 A * 12/1996 Hoffner ..... 52/529
5,638,649 A * 6/1997 Hovland ..... 52/233
5,787,661 A * 8/1998 Sharp ..... 52/233
5,799,452 A * 9/1998 Moore ..... 52/233
5,881,515 A * 3/1999 George ..... 52/233
6,122,877 A * 9/2000 Hendrickson et al. ..... 52/520
6,199,332 B1 * 3/2001 Ellson ..... 52/233
6,363,672 B1 * 4/2002 Baker ..... 52/233
6,408,580 B1 * 6/2002 Jurvis et al. ..... 52/233
6,427,414 B1 * 8/2002 Wing ..... 52/590.1
6,526,712 B2 * 3/2003 Brooks et al. ..... 52/287.1
2004/0211135 A1 * 10/2004 Stanton ..... 52/233
2004/0211136 A1 * 10/2004 Stanton ..... 52/233
2007/0175129 A1 * 8/2007 Nordli ..... 52/233

* cited by examiner

LOG-CABIN TYPE FACADE

The invention relates to a log-cabin type façade according to the generic part of claim 1 or 2.

From U.S. Pat. No. 5,638,649, a log-cabin type façade for cladding external walls is known that consists of several elongated contoured elements for cladding the surface of the wall that can be arranged over each other, and comprises corner-forming elements that are assigned to the side contours and can be arranged as trunks stacked over each other in a cross-bond in order to form an external corner. The contoured elements and corner-forming elements provide the appearance of a massive blockhouse-type building mode.

Designing this log-cabin type façade requires, provided identical contoured elements are used for cladding the wall sections for the formation of a external corner, the provision of corner-forming elements with a different design to erect the log-cabin type façade. Accordingly, right and left corner-forming elements are required in order to generate a bond that is to display no interfaces to an observer and, being an imitation, comes very close to a real log-cabin type façade. Because of the design of the different corner formations, the erection of a façade of this type is resource-consuming. Moreover, the contoured elements are disadvantageous in that they do not reside flush over each other after extended use, but rather they spread at the points of contact.

A façade cladding for the formation of a blockhouse-type external façade is also known from U.S. Pat. No. 6,199,332 B1, in which identically designed contoured elements are provided at the wall surfaces and different corner-forming elements are provided in the form of pre-milled wood stumps for a right and a left attachment. This embodiment is associated with the same disadvantages as the log-cabin type façade described before.

The invention is based on the object to propose a log-cabin type façade for walls in internal and external areas that, due to the simple design of the elements, facilitates rapid production and erection of the façade and facilitates assembly of the elements into a façade independent of their arrangement and orientation.

This object is met according to the invention by features of the independent claims 1 and 2.

The design of the façade according to the invention according to claim 1 is advantageous in that the elongated contoured elements are designed to be identical such that they can be used equally well on an internal wall and on an external wall and have the same attachments both on their right and on their left end. These elongated contoured elements can be used for the production of an internal corner as well as an external corner in internal and external areas. Moreover, the façade according to the invention is advantageous in that the corner-forming elements are also designed to be identical and can be used to form a cross bond on a left or right end of a tree trunk that is to be imitated independent of their arrangement.

This provides for simple and cost-efficient production of a façade. In addition, a simple kit consisting of two elements that allow an entire façade to be erected is provided. Contoured elements and corner-forming elements of this type can be provided in the form of a kit that facilitates simple erection by both an expert and a layman. Moreover, these simple geometric shapes of the contoured element and corner-forming element provide much freedom in the design.

Arranging a transverse recess near the front sides of the contoured elements for cross bonding of an opposite contour also allows an external corner and an internal corner to be produced by means of a contoured element.

The alternative embodiment of the façade according to the features of claim 2 of the invention possesses the same advantages as the façade according to claim 1. However, in contrast to the design of the façade according to claim 1, the elongated contoured element near the front sides is designed without transverse recess. In place of this transverse recess, an intermittent part is provided that is arranged between a contoured element and a corner connection element to produce an external corner. This intermittent element is not required to produce an internal corner.

This design according to the invention is advantageous in that it also facilitates simple assembly and the intermittent part is completely covered by the corner-forming element such that this intermittent part is no longer visible once the façade is erected. The intermittent part also is advantageous designed to be mirror-symmetrical such that the intermittent part is provided both for a right and a left attachment to a contoured element.

According to an advantageous embodiment of the invention the contoured elements or corner-forming elements and the intermittent parts are provided such as to be connectable by means of plug-in connection elements, preferably bolts, in particular made of wood or wooden dowels. This can provide for simple assembly at high stability that is facilitated by simple plugging-in or putting together.

According to an advantageous embodiment the invention provides for at least two plug-in connection elements to be provided between the contoured elements and corner-forming elements at each site of connection. By this means, a stable arrangement and attachment can be effected. Simultaneously, the presence of at least two connection elements provides for securing against torsion.

Advantageously, the invention provides for at least two bore holes for receiving the plug-in elements to be provided at each site of connection of the contoured element and the intermittent part. Accordingly, the individual elements for production of the façade are pre-made such that they can be put together simply without further processing.

According to a further advantageous embodiment, the invention provides for the corner connection elements to comprise at least two bore holes for receiving the plug-in connection elements at a left and a right section of an attachment surface. This allows for the corner connection element as such to be universally enabled for the arrangement of a left or right side or for production of a termination in X or Y direction of the cross bond. The plug-in connection elements are provided either on the at least two left or right bore holes of the attachment surface.

According to a preferred embodiment, the contoured elements are designed to have a semi-circular cross-section that comprises a circular external side imitating a tree trunk and an internal side with recesses serving as an abutment surface. The recesses provided on the internal side can, for example, be W- or V-shaped, triangular-shaped or of a similar shape. They are advantageous in that, provided natural wood is used as contoured element, splitting of the wood during the drying process is prevented. At the same time, utility lines can be inserted into these recesses, for example in order to supply energy to a wall lamp or similar to be attached to the façade. It is self-evident that any other application is also feasible.

According to a further advantageous embodiment, the contoured element comprises in an upper section thereof and along its longitudinal extension a tongue and, on the opposite bottom side, a groove designed to be complementary in shape. This facilitates that secure engagement of contoured elements arranged over each other for cladding of a wall surface is facilitated. The design of the groove and tongue also facilitates that bursting or waviness of individual sections of a contoured element upon extended use is prevented. In addition, this can produce a sealed arrangement.

It is advantageous to provide a fin surface on a bottom side of the contoured element between an external side and the groove, which fin surface is designed such that another contoured element can be placed thereon. This fin surface facilitates, on the one hand, that the design of the tongue of the contoured element arranged underneath it is completely covered. Simultaneously, the massive log cabin building mode character is enhanced. On the other hand, the fin surface facilitates that the penetration of moisture is prevented even upon driving rain or high wind velocities.

According to a preferred embodiment, the contoured element—as seen in a side view—comprises at each front side a quarter-circle-shaped milled recess that extends from a lower edge to the longitudinal middle plane and serves as second attachment surface and verges into a planar first attachment surface that extends to the upper end. This geometric design of the front side facilitates identical conditions for the sites of connection points to exist both in the one and in the other direction of assembly. Moreover, this design is advantageous in that a compact and sealed arrangement in the cross bond of trunks reaching over each other can be imitated. This contoured element is used in combination with the intermittent part and also forms the basis for a utilization without intermittent parts.

For utilization without intermittent part, the contoured element advantageously comprises near the first attachment surface and in a second attachment surface a contour that extends in transverse direction and is engaged by the tongue of the contoured element that is arranged in the cross bond and resides underneath. This facilitates that an attachment surface of the corner-forming element directly engages the first attachment surface of the contoured element. Simultaneously, this facilitates that, upon forming an internal corner, additional fixation is provided by the contoured elements themselves.

According to a further advantageous embodiment of the invention, the corner-forming elements, which consist of a round body, comprise at a bottom side a concave surface whose radius of curvature corresponds to the radius of the corner-forming element. This allows corner-forming elements to be stacked on top of each other such as to be flush and the optical impression is that of a massive log cabin building mode.

The corner-forming elements advantageously comprise at a front side a planar cut side that corresponds to the end surface of a trunk and, opposite to this, a first and second attachment surface that are provided analogous to the sites of connection of the contoured elements. This provides a simple and structural design and allows the contoured elements and corner-forming elements to be erected and put together easily.

Advantageously, the intermittent part is designed to be mirror-symmetrical such that its universal use is facilitated. With regard to its contouring, the intermittent part matches the attachment area next to the contoured element.

Advantageously, at least two bore holes for receiving plug-in connection elements are provided in each attachment surface of the intermittent part. Preferably, through bore holes are provided such that, for example, long socket pins are used that fully reach through the intermittent part and thus directly connect the contoured element to the corner-forming element.

According to a further advantageous embodiment of the invention, the contoured elements, the corner-forming elements, and the intermittent parts are provided to be made of wood. For external areas, it is preferred to use the wood of larch trees, Douglas firs. For internal areas or sauna construction, the wood of cedars, northern firs, hemlock firs, pine trees, oak trees or similar. Alternatively, the invention can provided for the use of wood imitations or, for example, plastic contoured elements with laminated wood or other basic structures onto which a laminate or an optical structure corresponding to wood is sprayed, glued or attached by similar means.

Further advantageous developments and embodiments of the invention are evident from the further claims.

The invention as well as further advantageous embodiments and developments thereof shall be described in more detail and illustrated in the following by means of the examples shown in the drawings. The features that are evident from the description and the drawings can be used individually or several thereof in any combination according to the invention. In the figures:

FIG. 1 shows a perspective view of a log-cabin type façade according to the invention for cladding an external corner;

FIG. 2*a* shows a perspective view of a contoured element for the façade according to FIG. 1;

FIG. 2*b* shows a schematic sectional view of the contoured element according to FIG. 2*a;*

FIG. 2*c* shows a schematic lateral view of the contoured element according to FIG. 2*a;*

Figure 1:
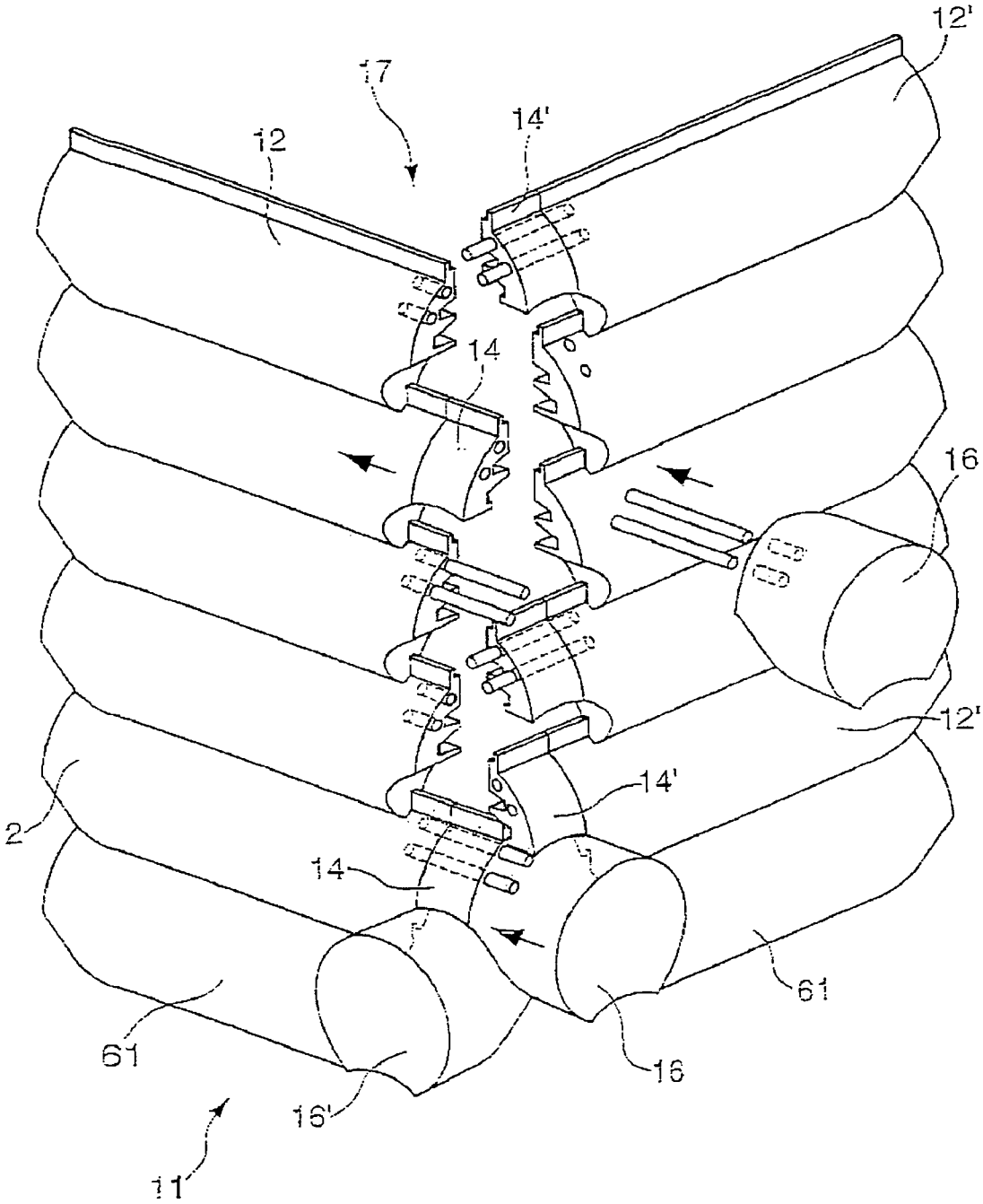

FIG. 1 shows a perspective view of a log-cabin type façade 11 according to the invention. This partly exploded view shows the joint action of elongated contoured elements 12 and intermittent parts 14 arranged thereon, which are assembled jointly with corner-forming elements 16 in order to form an external corner. The façade 11 can be provided both for internal areas and for external areas in order to clad a wall that is not shown in more detail. The assembly of the contoured elements 12, intermittent parts 14, and corner formations 16 shall be illustrated in more detail following the description of the individual elements.

Figure 2A:
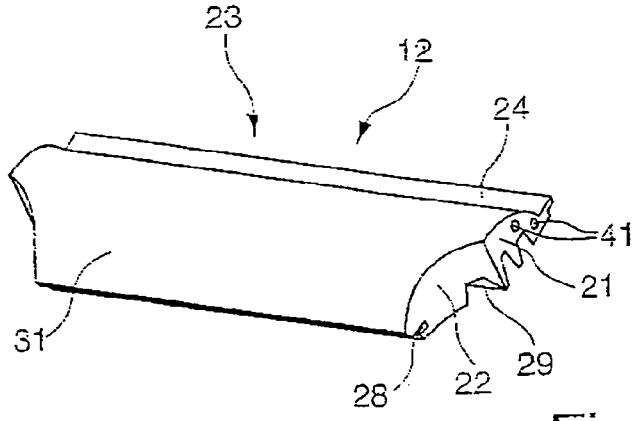
Figure 2B:
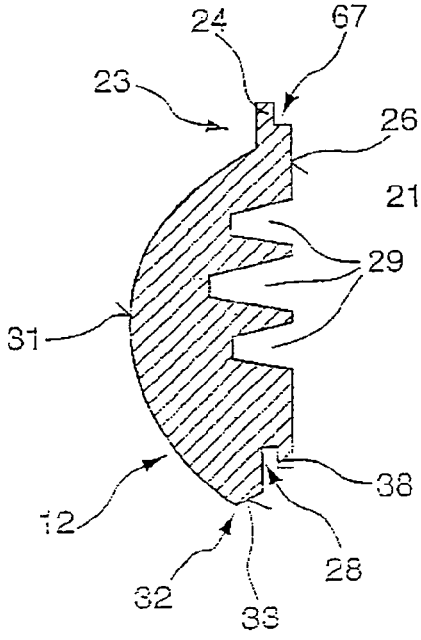

FIG. 2*a* shows the contoured element 12 for a façade 11 in a perspective view. The elongated contoured element 12 is designed in the form of a semi-circular contour as is shown in more detail in the sectional view according to FIG. 2*b*. The contoured element 12 is designed to be mirror-symmetrical about the middle axis 19 and comprises on each of its front sides a first planar attachment surface 21 that verges into a second attachment surface 22 that is formed by a quarter-circle-shaped milled recess. A tongue 24 is designed to reside at an upper section 23 of the contoured element 12 over the entire length in longitudinal extension of the contoured element 12. This tongue 24 is positioned at a distance from a back-side attachment surface 26. A groove 28 that is complementary in shape to tongue 24 is designed to reside at a bottom side of the contoured element 12. This groove 28 is staggered by the same distance with respect to an attachment surface 26 as the tongue 24 such that when the contoured elements 12 are stacked over each other secure engagement of the groove 28 by the tongue 24 is facilitated.

Figure 2C:
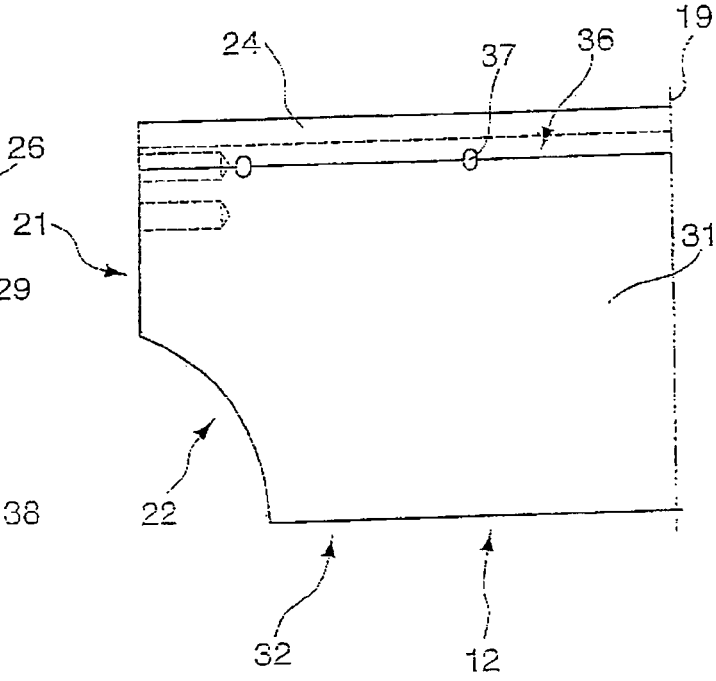

The contoured element 12 comprises recesses 29 that originate on the attachment surface 26. According to FIG. 2*b*, for example three recesses are provided, whereby the number and size of these recesses can be selected freely. Opposite from the attachment surface 26, an external side 31 is designed to reside that is designed to be nearly semi-circular in shape and ends on a lower section at a lower edge 32. From this edge 32 extends a fin surface 33 that inclines towards and to the groove 28. This fin surface advantageously has a concave surface whose radius of curvature corresponds to that of the external side 31. This fin surface 23 abuts flush on a contoured element 12 in the assembled state that is arranged below it and covers the groove 28 as well as attachment elements that are not shown in more detail, for example nails, that can be introduced in bore holes 37 (FIG. 2*c*) in a transitional area 36. These bore holes 37 extend diagonally downward to the attachment surface 26 such that the contoured element 12 can be attached to the wall and the attachment is not visible.

Accordingly, the contoured element 12 can be attached to the wall in transitional area 36. A contoured element 12 residing above it surrounds the tongue 24 by means of the groove 28, whereby a holding section 38 reaches behind the tongue 24 such that firm abutment of the lower section of the contoured element 12 residing on top to the contoured element 12 residing on the bottom is provided in this area. As before, fixation to the wall by attachment means is provided at the upper section of the contoured element 12 near the tongue 24.

Accordingly, a secure attachment of the contoured element 12 can be provided that also meets the requirements of load due to wind pressure.

Two bore holes 41 are made in the first attachment surface 21. These bore holes 41 serve for receiving plug-in connection elements 43 (FIG. 1). If natural wood is used for the log-cabin type façade, these plug-in connection elements 43 are provided in the form of so-called wooden dowels that can be plugged-in, pressed, if applicable, and/or glued in addition.

Figure 3:
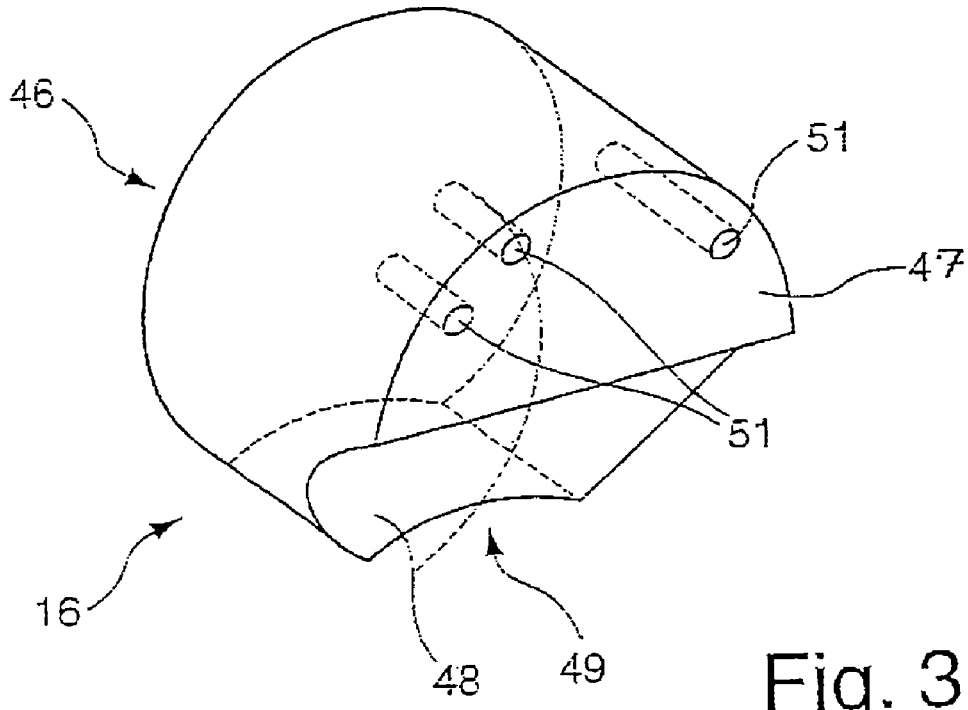
FIG. 3 shows a perspective view of a corner-forming element for a façade according to FIG. 1.

FIG. 3 shows the corner-forming element 16 in more detail. The corner-forming element 16 is made from a circular body, preferably a round wood stump, and comprises, on its back side, a planar cut surface 46 that is designed like the end surface of a trunk. A first attachment surface 47 is designed to reside opposite from this. This attachment surface 47 is planar and comprises a semi-circular area. Adjacent to this, there is a second attachment surface 48 that is designed to be a quarter-circle-shaped milled recess as seen in the side view of the corner-forming element 16. This attachment surface 48 serves for abutment on the imitated trunk positioned underneath that is staggered by 90° in the cross bond.

A concave surface 49 is provided on a bottom side of the corner-forming element and has a radius of curvature that corresponds to the radius of the stump of the corner thus formed.

A right and a left pair of bore holes 51 are provided on the first attachment surface 47. This facilitates the sue of the corner-forming element 16 as left and also as right terminating element.

Figure 4:
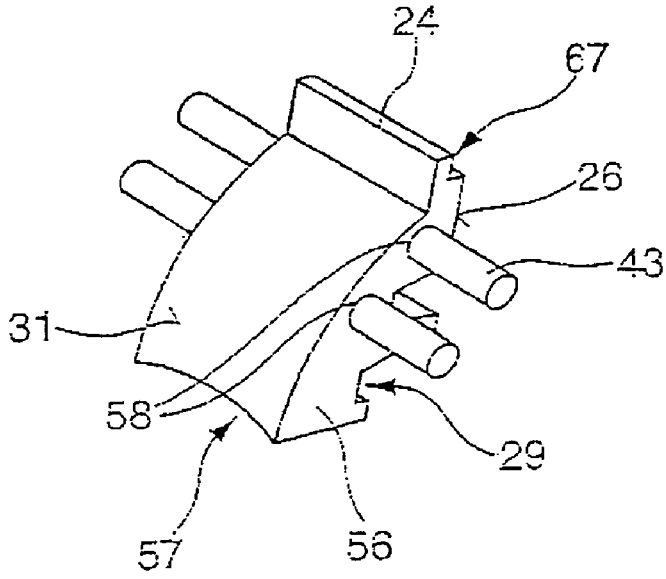
FIG. 4 shows a perspective view of an intermittent part for a façade according to FIG. 1.

FIG. 4 shows a perspective view of the intermittent part 14. The intermittent part 14 comprises an attachment surface 56 that is preferably designed to be congruent to the first attachment surface 21 of the contoured element 12. At the lower end of the intermittent part 14, a concave surface 57 is provided whose radius of curvature corresponds to the radius of the corner-forming element 16. This surface 57 verges directly into the second attachment surface 22 when the intermittent part 14 is positioned with respect to one front side of the contoured element 12 to form the contour.

The intermittent part 14 advantageously comprises through bore holes 58 such that the plug-in connection elements 43 fully reach through the intermittent part 14 and are designed to reside on the right and left side for receiving the contoured element 12 and the corner-forming element 16.

The façade 11 according to FIG. 1 is built-up on a base 61. One contoured element 12, one intermittent part 14 attached thereto, and one corner-forming element 16 are arranged in one direction of space. Subsequently, one contoured element 12', intermittent element 14', and a corner-forming element that is not shown in more detail are assembled in a second direction of space and placed on a base 61 in the further direction of space. The corner-forming element for the second direction of space fully covers the intermittent part 14 such that this intermittent part 14 is not visible when the façade is completed. The build-up of the log-cabin type façade in a cross bond then proceeds alternating in the directions of space such that the individual elements can engage and fix each other.

The invention also facilitates that firstly the contoured elements 12 and 12' are arranged and then the intermittent parts 14, 14' are attached by means of the plug-in connection elements 43 either individually or jointly with the corner-forming elements 16, 16'.

Figure 5:
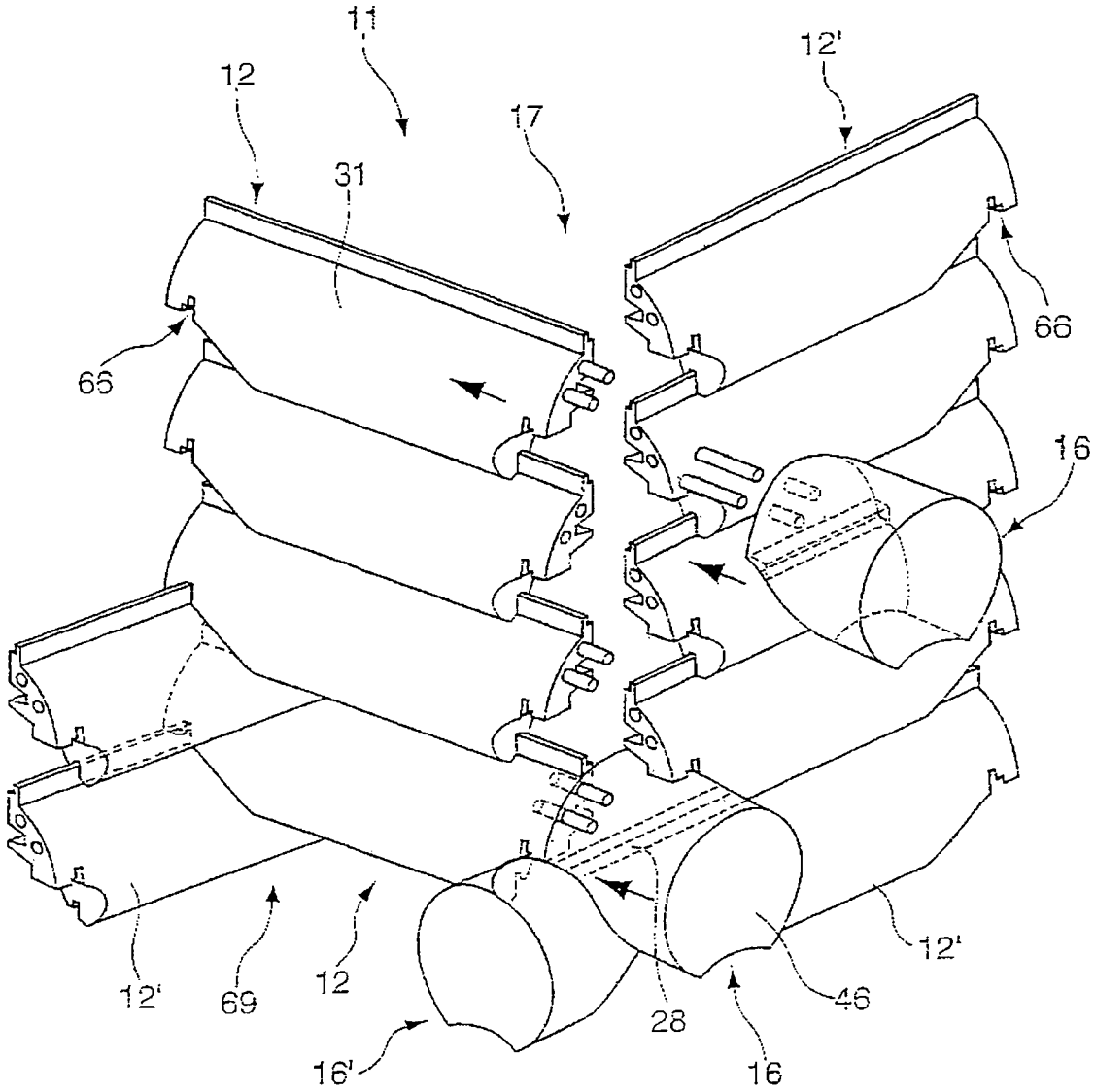
FIG. 5 shows a perspective view of a further log-cabin type façade according to the invention.
Figure 6:
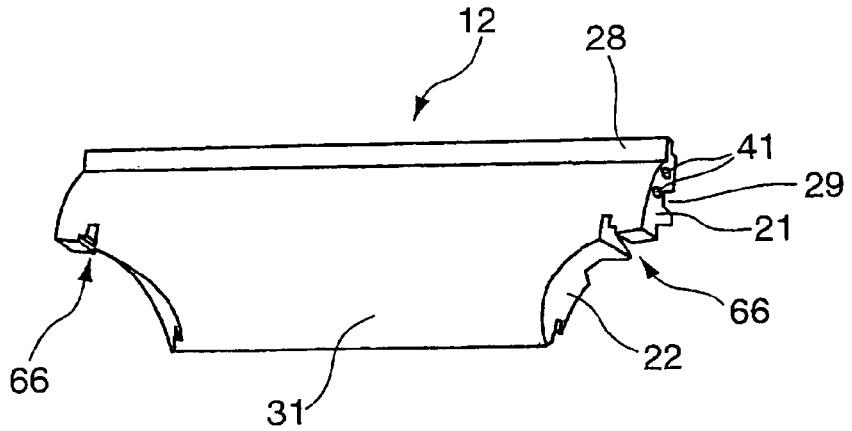
FIG. 6 shows a perspective view of a contoured element for a façade according to FIG. 5.

FIG. 5 shows a further alternative design of the log-cabin type façade 11 according to the invention. This façade 11 differs from the façade shown in FIG. 1 in that contoured elements 12 and corner-forming elements 16 that are positioned with respect to each other by means of plug-in connection elements 43 are used to produce this façade. For this purpose, the contoured element 12, shown in a perspective view in FIG. 6, is modified as compared to the contoured element 12 shown in FIG. 2 and comprises in the second attachment surface 22 near the first attachment surface 21 a transverse recess 66. This recess corresponds to the groove 24 and a shoulder 67 that is designed to reside in the upper area of the contoured element 12. This transverse recess 66 facilitates simple arrangement of the contoured elements 12 with respect to each other for the design of an internal corner 69. The groove 24 of the contoured element 12 engages the recess 66 of the contoured element that is positioned above it and forms a fixation.

Figure 7:
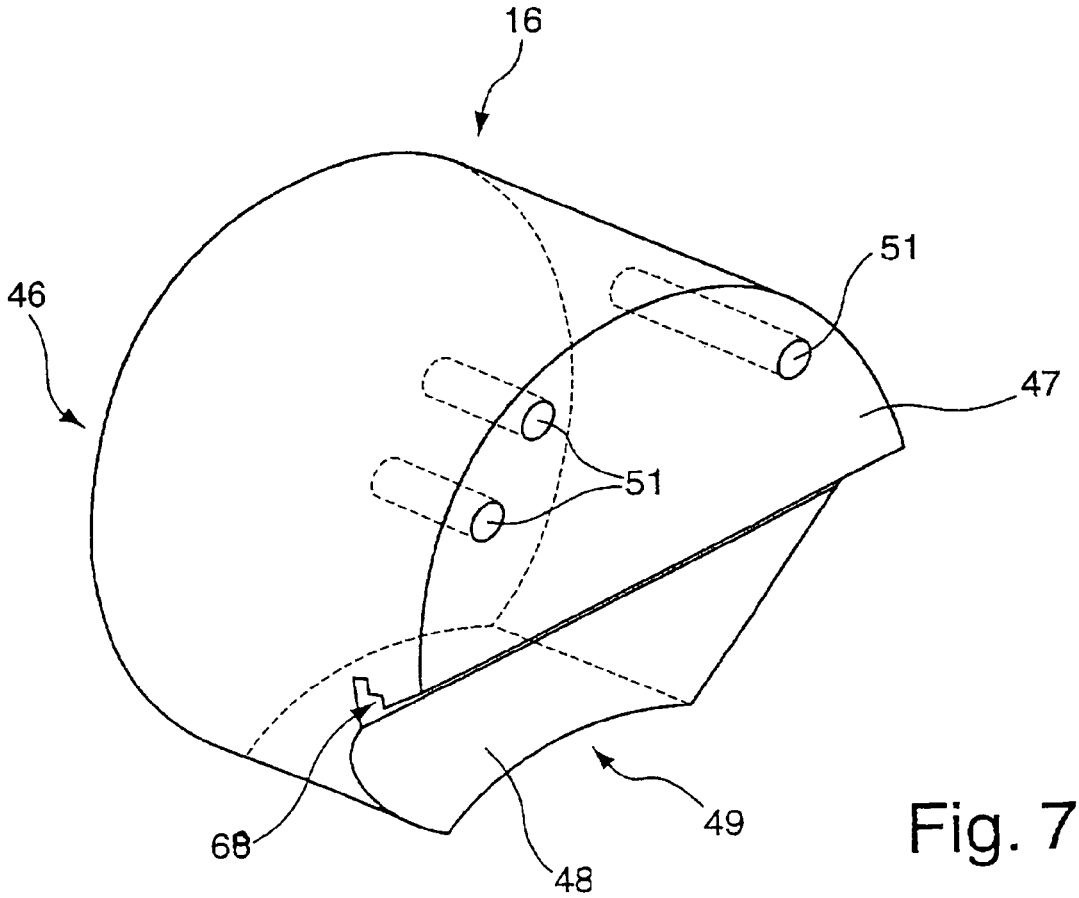
FIG. 7 shows a perspective view of a corner-forming element for a façade according to FIG. 5.

The corner-forming element 16 according to FIG. 7 for the façade 11 according to the invention according to FIG. 5 differs from the corner-forming element 16 according to FIG. 3 in that a recess 68 corresponds to that of the contoured element 12 according to FIG. 6 is provided in the second attachment surface 48. This facilitates flush abutment of the first attachment surface 47 of the corner-forming element 16 on the first planar attachment surface 21 of the contoured element 12 and dispenses with the need to mill the nut 24 in the crossing area of the contoured elements 12 and/or in the area of the outer end of the contoured elements 12.

The assembly of the façade 11 according to FIG. 5 proceeds as follows:

Prior to using the contoured element 12 for assembly, the corner-forming element 16 is attached to the contoured element 12 and the entire structure is placed on the contoured element 12 residing underneath. Then the milled recess 66 engages the tongue 24 of the contoured element 12 that is positioned transverse-underneath and is staggered by 90°, preferably over half of the length of the corner-forming element 16. This provides for bracing of the corner.

Alternatively, the designs of the corner—as seen in the top view—can be provided to deviate from a 90° angle. The transverse milled recesses 66 are then adjusted accordingly to the given angle.

The façade 11 according to the invention according to FIGS. 1 to 5 is advantageous in that a building kit with elements is designed that can be used equally well for a left and for a right orientation or side. This simplifies the assembly significantly. This facilitates a façade that corresponds to the appearance of a log-cabin type façade.

The invention claimed is:

1. Log-cabin type facade for cladding walls in internal and external areas with at least two elongated contoured elements for cladding a wall surface, which are arranged over each other, with corner-forming elements that are assigned to the contoured elements and are arranged in the form of stumps reaching over each other in a cross bond, whereby the contoured elements and the corner-forming elements jointly take on the appearance of a massive blockhouse-type building mode, characterized in that the contoured elements are designed to be mirror-symmetrical in their longitudinal extension and comprise near their respective front sides a transverse recess for contoured elements positioned opposite one another to connect in the cross bond;

the corner-forming elements are designed in the form of round wood stumps with a cut surface that forms an end surface and comprise, on the opposite side, a first planar attachment surface and, adjacent to this and adapted to an external side of the crossing contoured element and corner-forming element a second attachment surface; and the contoured elements and the corner-forming elements provide a building kit for designing a facade for an external corner and an internal corner.

2. Facade according to claim 1, characterized in that the contoured elements and the corner-forming elements are connected to each other by means of plug-in connection elements.

3. Facade according to claim 1, characterized in that at least two plug-in connection elements are provided at each site of connection between the contoured elements and the corner-forming elements.

4. Facade according to claim 1, characterized in that at least two bore holes for receiving the plug-in connection elements are provided at each site of connection of the contoured element.

5. Facade according to claim 1, characterized in that the corner-forming elements each comprise in a left and right section of the first attachment surface at least two bore holes for receiving the plug-in connection elements.

6. Facade according to claim 1, characterized in that the contoured element is designed as a semi-circular contour as seen in a cross-section that comprises a circular external side imitating a tree trunk and an attachment surface that is planar at least in part.

7. Facade according to claim 1, characterized in that the contoured element comprises in an upper section thereof and along its longitudinal extension a tongue and, on the opposite bottom side, a groove designed to be complementary in shape.

8. Facade according to claim 1, characterized in that a fin surface is provided on the bottom side of the contoured element between an external side and a groove, whereby said fin surface and a contoured element that is assigned to and positioned adjacent to the fin surface form an overlapping area.

9. Facade according to claim 1, characterized in that the contoured element—as seen in a side view—comprises at each front side a circular segment-shaped milled recess that extends from a lower edge to the longitudinal middle plane and serves as second attachment surface and verges into a first planar attachment surface that extends to the upper end of the contoured element.

10. Facade according to claim 4, characterized in that the bore holes are provided in the planar attachment surface of the contoured element.

11. Facade according to claim 1, characterized in that the contoured element comprises in the second attachment surface near the first attachment surface a recess that extends transverse with respect to the longitudinal extension of the contoured element, whereby said transverse recess comprises a contour for receiving at least the tongue of a further contoured element that is arranged in the cross bond.

12. Facade according to claim 1, characterized in that the corner-forming element consists of a round body that comprises on a bottom side thereof a concave surface whose radius of curvature corresponds to the radius of the corner-forming element.

13. Facade according to claim 1, characterized in that a planar cut surface is designed as the end surface of a trunk on a front side of the corner-forming element and in that the opposite front side, as seen in the lateral view, comprises in an upper half thereof a planar attachment surface that verges into a second attachment surface that is formed by a circle segment-shaped milled recess whose radius of curvature corresponds to the radius of the corner-forming element.

14. Facade according to claim 1, characterized in that the corner-forming element comprises a recess between a first attachment surface and a second attachment surface.

15. Facade according to claim 1, characterized in that the contoured element comprises bore holes in a transition area between the external side and the tongue, which bore holes are arranged to extend diagonally downward when viewed from outside to inside.

16. Facade according to claim 1, characterized in that the contoured elements and the corner-forming elements are designed to be made from the wood of larch trees or Douglas firs for external areas and from the wood of pine trees, oak trees, northern firs, cedars, hemlock firs or as imitation wood for internal areas.

17. Facade according to claim 2, characterized in that the plug-in connection elements are made of wood or wooden dowels.

* * * * *